United States Patent [19]

Tanaka et al.

[11] Patent Number: 4,503,907

[45] Date of Patent: Mar. 12, 1985

[54] HEAT EXCHANGER COATED WITH AQUEOUS COATING COMPOSITION

[75] Inventors: Tatsumi Tanaka, Odawara; Kiyoshi Hikita; Masaru Furuhashi, both of Yokohama; Toshio Hatada, Shimizu; Katsuzi Nakano, Shimizu; Akira Arai, Shimizu, all of Japan

[73] Assignee: Hitachi, Ltd., Tokyo, Japan

[21] Appl. No.: 156,794

[22] Filed: Jun. 5, 1980

[30] Foreign Application Priority Data

Jun. 8, 1979 [JP] Japan ..... 54-71230

[51] Int. Cl.[3] ..... F28F 19/02

[52] U.S. Cl. ..... 165/133; 165/DIG. 12; 524/539; 524/598; 524/601

[58] Field of Search ..... 428/457 I, 331; 260/29.6 R; 526/62; 165/DIG. 18, 133; 524/492, 493, 375, 377, 539, 598, 601; 529/377

[56] References Cited

U.S. PATENT DOCUMENTS

| | | | |
|---|---|---|---|
| 2,015,796 | 10/1935 | Hans et al. | 260/29.6 R |
| 2,099,665 | 11/1937 | Smith | 165/DIG. 18 |
| 2,396,607 | 3/1946 | Rogers | 260/29.6 R |
| 2,469,729 | 5/1949 | Hunter | 165/DIG. 18 |
| 3,067,053 | 12/1962 | Tarantino | 524/377 |
| 3,466,189 | 9/1969 | Erb | 165/133 |
| 4,067,838 | 1/1978 | Hayashi et al. | 523/414 X |
| 4,153,592 | 5/1979 | Burroway et al. | 524/377 |
| 4,178,400 | 12/1979 | Lochel, Jr. | 260/29.6 R |
| 4,293,458 | 10/1981 | Gruenberger | 260/29.6 R |

*Primary Examiner*—Sheldon J. Richter
*Assistant Examiner*—Randolph A. Smith
*Attorney, Agent, or Firm*—Antonelli, Terry & Wands

[57] ABSTRACT

A heat exchanger, e.g. that used in an air-conditioner, having a plurality of spaced plate-fins with narrow distance in parallel and a plurality of heat transfer pipes passing through said fins, said fins being coated with an aqueous coating composition comprising 100 parts by weight of a resin composition for water paint in solids content, 5 to 95 parts by weight of a surface active agent and 5 to 65 parts by weight of synthetic silica and baked at a temperature of 120° C. to 200° C. for 10 to 40 minutes to give a coating film of 3 to 20 μm, has excellent hardness and corrosion resistance without damaging hydrophilic properties.

9 Claims, 5 Drawing Figures

HEAT EXCHANGER COATED WITH AQUEOUS COATING COMPOSITION

BACKGROUND OF THE INVENTION

This invention relates to a heat exchanger produced by using aluminum or its alloys in part or whole of the component parts of heat exchanger which has winding heat exchange tubes fixed by a plurality of spaced plate-fins and is particularly excellent in corrosion resistance and heat exchange properties.

Aluminum and its alloys are widely used in the field of heat exchangers because they are light in weight, excellent in workability, corrosion resistance and heat conductivity, and less expensive than copper materials. Heat exchangers made of aluminum or its alloys are usually used in air-conditioners for cooling and heating.

When an air-conditioner is operated for cooling, the moisture in the air is condensed to water and adheres to the surfaces of aluminum fins of the heat exchanger by dehumidification. The water drops adhered to the surfaces of fins are present in the form of semicircle or bridging state between fins due to poor hydrophilic nature of the fins, which results in preventing smooth flow of air and increasing resistance to flow.

On the other hand, aluminum and its alloys are excellent in corrosion resistance. But when condensed water remains on the aluminum fins for a long period of time, the formation of an oxygen concentration cell or gradual adsorption and condensation or contaminants in the atmosphere accelerates the hydration reaction and corrosion reaction. Corrosion product is deposited on the surfaces of fins, which not only affects heat exchange properties badly but also undesirably releases a white fine powder delaminated from the fins together with warm air from the exhaust grill with the air-conditioner is operated for heating in winter.

Therefore excellent corrosion resistance is required for the aluminum fins constituting the heat exchanger. Heretofore, there have been employed various methods of corrosion proofing treatments by forming organic resin protective films or chemical protective films (the boemite method, the chromate method, and the like). But such corrosion proofing treatments give various defects, such as hydrophilic properties (wettability) of the aluminum surface being reduced, condensed water being easily adhered to fin surfaces when the air-conditioner is operated for cooling, and the air flow resistance of the heat exchanger being remarkably increased. In view of these defects the noise increases and the performance is lowered.

In such a case, if the aluminum fins are coated with a paint and the condensed water is completely absorbed on the coated film or the coated film is wetted uniformly by the condensed water, such defects as mentioned above may be overcome. Alternatively, the condensed water may completely be repelled by the coated film so as not to make the water to adhere to the coated film.

As the prior art, there are known Japanese Patent Appln Kokai (Laid-Open) Nos. 57264/79 (a heat exchanger), 1450/79 (a cooler) and 14450/78 (a heat exchanger having good hydro-extraction properties). According to Kokai No. 57264/79, the surface of heat exchanger produced by using aluminum or its alloys is treated with an aqueous solution containing silicate compounds such as water-soluble or water-dispersible silicates, and subsequently treated with an alkaline aqueous solution containing one or more alkaline earth metal compounds such as hydroxides, oxides, chlorides, acetates, nitrates and the like of alkaline earth metals to form a chemical coating on the surface of aluminum or its alloys so as to improve corrosion resistance of the aluminum fins and at the same time to increase hydrophilic properties of the fin surface, so that the heat exchanger having improved durability and performance is obtained. According to Kokai No. 1450/79, aluminum fins are dipped in an alkaline treating solution containing one or more organic acid such as tannic acid, and the like at 15°–45° C. for 30 to 90 seconds to form crystalline coating so as to prevent change in quality due to air oxidation and to make the surface tension small so as not to reduce air flow amount when air is flowed between the fins. According to Kokai No. 14450/78, the aluminum fin surface is treated with boemite ($\gamma$-$Al_2O_3$·$H_2O$ or AlOOH) or calcium aluminate, or coated with polymer compounds as a paint such acrylic resins, polyurethane resins, etc., followed by treatment with a surface active agent to provide hydrophilic properties so as to improve hydro-extraction of the aluminum surface and heat exchange efficiency.

But it is remarkably difficult to obtain a coating film which can completely repel condensed water (the contact angle of water drop being 90 degrees or larger). On the other hand, a coating film which can absorb condensed water, i.e. so-called hydrophilic coating film is usually insufficient in surface hardness and since the coating film contains a large amount of water inside of the film under humid air condition, surface hardness of the coating film is remarkably lowered due to swelling of the resin in the coating film and wear resistance is also lowered; this becomes one factor for lowering corrosion resistance.

As mentioned above, since there is an inconsistent relationship between the hydrophilic properties and the surface hardness, and corrosion resistance, it has been a great problem to find a balanced point or compromising point.

SUMMARY OF THE INVENTION

It is an object of this invention to improve corrosion resistance and heat exchange properties of heat exchangers by coating an aqueous coating composition having excellent surface hardness and corrosion resistance without damaging hydrophilic properties (wettability).

In order to attain such an object, according to this invention, both surfaces of aluminum fins of a heat exchanger are coated with an aqueous coating composition comprising one or more resins for water paint, surface active agents and synthetic silica by spray coating, electrostatic coating, dip coating, shower coating, etc., in 3 to 20 $\mu$m thick, followed by baking at 120° C. to 200° C. for 10 to 40 minutes to cure the fin surface.

By conducting the above-mentioned treatment, hardness of the fin surfaces becomes high and the coating film having excellent corrosion resistance and hydrophilic properties is formed. Thus, resistance to air flow of the heat exchanger is remarkably reduced, noise of a blower at the time of cooling is lowered, and cooling ability is enhanced; these make practical effects remarkably great.

DETAILED DESCRIPTION OF THE PREFERRED EMBODIMENTS

Figure 1:
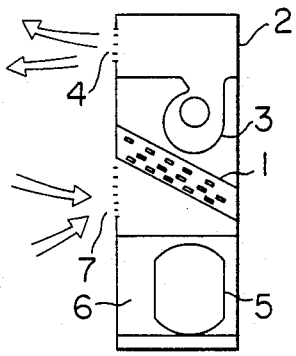
FIG. 1 is a construction drawing of an air-conditioner for cooling and heating.
Figure 2:
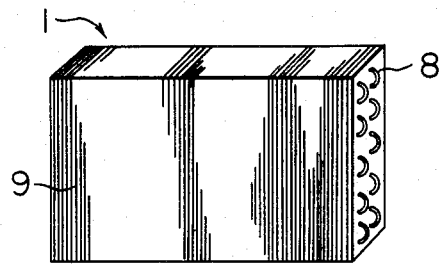
FIG. 2 is a perspective view of a heat exchanger.

In the construction drawing of the air-conditioner for cooling and heating shown in FIG. 1, a heat exchanger 1 is installed in an inclined position in almost the center of the body of air-conditioner 2. A blower 3 is fixed on the body of air-conditioner 2 above the heat exchanger 1 and an air blow-off grill 4 is formed at the front wall of the body of air-conditioner 2 and the blow-off side of the blower 3. Below the heat exchanger 1, there is a machine chamber 6 containing machines such as a compressor 5, a condenser (not shown in the drawing), and the like. Numeral 7 denotes an air suction grill. Freezing cycle is formed by connecting the above-mentioned machines, expansion valves not shown in the drawing and the like with pipes. The heat exchanger 1 has a plurality of aluminum fins 9 as shown in FIG. 2 with narrow distance in parallel to form flow passages. These fins are fixed by passing through a lot of heat transfer pipes 8. The surfaces of said aluminum fins 9 are coated with an aqueous coating composition. The aqueous coating composition can be coated uniformly by spray coating, electrostatic coating, dip coating, shower coating or the like conventional coating methods so as to form a coating film of 3 to 20 μm thick after dried, followed by baking at 120°-200° C. for 10 to 40 minutes so as to enhance surface hardness.

The aqueous coating composition used in this invention can be prepared by mixing one or more resins for water paint, surface active agents, synthetic silica, solvents (such as isopropyl alcohol, butyl cellosolve, etc.), and if required, pigments and dyes to give a desired color by using a conventional dispersion mixer for paint and varnish followed by further dispersion by addition of water.

As the resins for water paint, there can be used water-soluble resins such as acrylic, alkyd, polyester, epoxy, acrylic-alkyd resins etc., or a mixture of one or more water-dispersible resins such as alkyd resin, acrylic resin, polyester resin, etc., and one or more water-soluble amino resins such as melamine resins, etc. The water-soluble amino resins can also be used alone as the resin.

As the surface active agents, there can be used nonionic, anionic, cationic and amphoteric surface active agents singly or as a mixture thereof. Among the surface active agents, taking foaming phenomenon due to air flow during the operation of the heat exchanger into consideration, there can preferably be used those having low foaming such as nonionic surface active agents, e.g. polyoxyethylene nonylphenol ether, polyoxyethylene octylphenol ether, oxyethylene block polymer, oxypropylene block polymer, polyoxyethylene glycol, and the like.

The surface active agent is preferably used in an amount of 5 to 95 parts by weight, more preferably 35 to 85 parts by weight, per 100 parts by weight of the solids content of the resin component for water paint. If the amount of the surface active agent is less than 5 parts by weight, transport ability for condensed water is too insufficient to show the effects of this invention, while if the amount of the surface active agent is more than 95 parts by weight, sufficient surface hardness and corrosion resistance of the coating film cannot be obtained.

The same effects can also be obtained when the surface active agent is used as a part of functional groups in the synthesis of the resin for water paint.

Synthetic silica can be obtained as a precipitate as a result of the reaction of a silicate solution with carbon dioxide or an acid. Synthetic silica is very porous and has a particle size of micron order and usually has hydroxyl groups on the surface thereof. Synthetic silica is used in an amount of preferably 5 to 65 parts by weight, more preferably 15 to 55 parts by weight, based on 100 parts by weight of the solids content of the resin component for water paint. If the amount of synthetic silica is less than 5 parts by weight, absorption ability for condensed water is too little to show the effects of this invention, while if the amount of synthetic silica is more than 65 parts by weight, film forming properties are remarkably lowered as cannot be used practically. (The film forming properties can be improved by the combined use of a surface active agent).

The mixing ratios of the surface active agent and synthetic silica are derived from the following experimental results.

A water-soluble alkyd resin (WATERSOL S-126, solid content 50±2%, manufactured by Japan Reichhold Co.), a water-soluble melamine resin (NIKALAC MW22, solids content 70±2%, manufactured by Sanwa Chemical Co.), a nonionic surface active agent (NONION NS210, polyoxyethylene nonylphenol ether, manufactured by Nippon Oil & Fats Co., Ltd.,) synthetic silica and butyl cellosolve in amounts as listed in Table 1 are dispersed in a dispersion mixer for paint and subsequently water is added to the dispersion to give an aqueous coating composition having a solids content of 20% by weight. The aqueous coating composition is coated on aluminum fins of a heat exchanger by dip coating (film thickness being 7 to 9 μm after dried) and baked at 150° C. for 20 minutes. The resulting coating film is tested under the same conditions as described in Table 4 mentioned hereinafter as to pencil hardness, adhesiveness, hydrophilic properties, and water resistance. Film forming properties are judged by observing the state of film forming by the naked eye. Experimental results are as shown in Table 1.

TABLE 1

| Run No. | A1 | A2 | A3 | A4 | B1 | B2 | B3 | B4 | C1 | C2 | C3 | C4 | D1 | D2 |
|---|---|---|---|---|---|---|---|---|---|---|---|---|---|---|
| Water-soluble alkyd resin (parts by weight) | 48.0 | 48.0 | 48.0 | 48.0 | 48.0 | 48.0 | 48.0 | 48.0 | 48.0 | 48.0 | 48.0 | 48.0 | 48.0 | 48.0 |
| Water-soluble melamine resin (parts by weight) | 8.6 | 8.6 | 8.6 | 8.6 | 8.6 | 8.6 | 8.6 | 8.6 | 8.6 | 8.6 | 8.6 | 8.6 | 8.6 | 8.6 |
| Nonionic surface active agent (parts by weight) | 1.2 | 1.2 | 1.2 | 1.2 | 1.8 | 1.8 | 1.8 | 1.8 | 10.2 | 10.2 | 10.2 | 10.2 | 10.8 | 10.8 |
| Synthetic silica (parts by weight) | 1.2 | 1.8 | 19.2 | 19.8 | 1.2 | 1.8 | 19.2 | 19.8 | 4.2 | 4.8 | 16.2 | 16.8 | 4.2 | 4.8 |
| Butyl cellosolve (parts by weight) | 41.0 | 40.4 | 23.0 | 22.4 | 40.4 | 39.8 | 22.4 | 21.8 | 29.0 | 28.4 | 17.0 | 16.4 | 28.4 | 27.8 |
| Parts by weight per 100 parts by weight of the solids content of the resin component — Surface active agent | 4 | 4 | 4 | 4 | 6 | 6 | 6 | 6 | 34 | 34 | 34 | 34 | 36 | 36 |
| Parts by weight per 100 parts by weight of the solids content of the resin component — Synthetic silica | 4 | 6 | 64 | 66 | 4 | 6 | 64 | 66 | 14 | 16 | 54 | 56 | 14 | 16 |
| Pencil hardness | H | H | HB | HB | H | H | HB | HB | H | H | H | F | H | H |
| Adhesiveness (Cross-cut test) | 100/100 | 100/100 | 50/100 | 50/100 | 100/100 | 100/100 | 75/100 | 75/100 | 100/100 | 100/100 | 100/100 | 100/100 | 100/100 | 100/100 |
| Hydrophilic properties | x | x | x | x | x | Δ | Δ | Δ | ○ | ○ | ○ | ○ | ○ | ◎ |
| Water resistance | ◎ | ◎ | Δ | x | ◎ | ◎ | Δ | x | ◎ | ◎ | ◎ | ◎ | ◎ | ◎ |
| Film forming properties | ◎ | ◎ | Δ | x | ◎ | ◎ | ○ | Δ | ◎ | ◎ | ◎ | ◎ | ◎ | ◎ |

| Run No. | D3 | D4 | E1 | E2 | E3 | E4 | F1 | F2 | F3 | F4 | G1 | G2 | G3 |
|---|---|---|---|---|---|---|---|---|---|---|---|---|---|
| Water-soluble alkyd resin (parts by weight) | 48.0 | 48.0 | 48.0 | 48.0 | 48.0 | 48.0 | 48.0 | 48.0 | 40.0 | 40.0 | 48.0 | 48.0 | 40.0 |
| Water-soluble melamine resin (parts by weight) | 8.6 | 8.6 | 8.6 | 8.6 | 8.6 | 8.6 | 8.6 | 8.6 | 7.2 | 7.2 | 8.6 | 8.6 | 7.2 |
| Nonionic surface active agent (parts by weight) | 10.8 | 10.8 | 25.2 | 25.2 | 25.2 | 25.2 | 25.8 | 25.8 | 21.5 | 21.5 | 28.2 | 28.2 | 23.5 |
| Synthetic silica (parts by weight) | 16.2 | 16.8 | 4.2 | 4.8 | 16.2 | 16.8 | 4.2 | 4.8 | 13.5 | 14.0 | 1.2 | 1.8 | 16.0 |
| Butyl cellosolve (parts by weight) | 16.4 | 15.8 | 14.0 | 13.4 | 2.0 | 1.4 | 13.4 | 12.8 | 17.8 | 17.3 | 14.0 | 13.4 | 13.3 |
| Parts by weight per 100 parts by weight of the solids content of the resin component — Surface active agent | 36 | 36 | 84 | 84 | 84 | 84 | 86 | 86 | 86 | 86 | 94 | 94 | 94 |
| Parts by weight per 100 parts by weight of the solids content of the resin component — Synthetic silica | 54 | 56 | 14 | 16 | 54 | 56 | 14 | 16 | 54 | 56 | 4 | 6 | 64 |
| Pencil hardness | H | F | H | H | H | F | H | H | F | F | B | HB | B |
| Adhesiveness (Cross-cut test) | 100/100 | 100/100 | 100/100 | 100/100 | 100/100 | 100/100 | 100/100 | 100/100 | 100/100 | 100/100 | 100/100 | 100/100 | 100/100 |
| Hydrophilic properties | ◎ | ◎ | ○ | ◎ | ◎ | ◎ | ◎ | ◎ | ◎ | ◎ | Δ | Δ | ◎ |
| Water resistance | ◎ | ◎ | ◎ | ◎ | ◎ | ○ | ○ | ○ | ○ | ○ | x | Δ | Δ |
| Film forming properties | ◎ | ◎ | ◎ | ◎ | ◎ | ◎ | ◎ | ◎ | ◎ | ◎ | ◎ | ◎ | ◎ |

| Run No. | G4 | H1 | H2 | H3 | H4 | Y1 | Y2 | Y3 |
|---|---|---|---|---|---|---|---|---|
| Water-soluble alkyd resin (parts by weight) | 40.0 | 48.0 | 48.0 | 40.0 | 40.0 | 48.0 | 48.0 | 48.0 |
| Water-soluble melamine resin (parts by weight) | 7.2 | 8.6 | 8.6 | 7.2 | 7.2 | 8.6 | 8.6 | 8.6 |
| Nonionic surface active agent (parts by weight) | 23.5 | 28.8 | 28.8 | 24.0 | 24.0 | — | 28.5 | — |
| Synthetic silica (parts by weight) | 16.5 | 1.2 | 1.8 | 16.0 | 16.5 | — | — | 19.0 |
| Butyl cellosolve (parts by weight) | 12.8 | 13.4 | 12.8 | 12.8 | 12.3 | 43.4 | 14.9 | 24.4 |
| Parts by weight per 100 parts by weight of the solids content of the resin component — Surface active agent | 94 | 96 | 96 | 96 | 96 | — | 95 | — |
| Parts by weight per 100 parts by weight of the solids content of the resin component — Synthetic silica | 66 | 4 | 6 | 64 | 66 | — | — | 63 |
| Pencil hardness | 2B | B | B | 2B | 2B | H | 2B | F |
| Adhesiveness (Cross-cut test) | 95/100 | 100/100 | 100/100 | 100/100 | 95/100 | 100/100 | 100/100 | 50/100 |
| Hydrophilic properties | ◎ | Δ | Δ | ◎ | ◎ | x | x | Δ |
| Water resistance | x | x | x | x | x | ◎ | ◎ | x |
| Film forming properties | ○ | ◎ | ◎ | ◎ | ○ | ◎ | ◎ | x |

Figure 3:
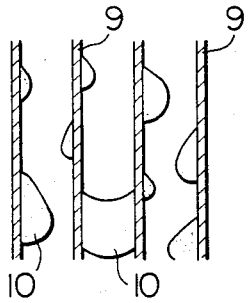
FIG. 3 is a cross sectional view of fins of a conventional heat exchanger in which water drops are adhered to the fins.

As shown in Table 1, test samples are divided into 9 kinds of blocks A, B, C, D, E, F, G, H and Y, each block having 3 or 4 samples. The amount of surface active agent is changed 4, 6, 34, 36, 84, 86, 94, 95 and 96 parts by weight based on 100 parts by weight of the solids content of the resin component for water paint and the amount of synthetic silica is also changed from 6 to 66 parts by weight depending on the amount of the surface active agent. In each test item, pencil hardness is expressed by H series, F and B series: adhesiveness is evaluated by the cross-cut test showing area ratio of retained area to original area; and hydrophilic properties, water resistance and film forming properties are evaluated by the marks ◎, ○, Δand x. The mark ◎ means no change, the mark ○ means that white rust is slightly produced, the mark Δ means that white rust is partly produced and partly peeled off, and the mark x means that white rust is remarkably produced and peeled off. As to the hydrophilic properties, the mark ◎ means that water drop is instantly absorbed by the coating film, the mark ○ means that water drop is absorbed within 5 minutes, the mark Δ means that water drop is absorbed within 30 minutes, and the mark x means that water drop is not absorbed but takes the form of bridging as shown in FIG. 3.

As is clear from Table 1, as to the amount of the surface, active agent, practically useful effect is obtained from between 4 and 6 parts by weight, i.e. 5 parts by weight, to between 94 and 96 parts by weight, i.e. 95 parts by weight, i.e. within the range of 5 to 95 parts by weight. Particularly better effect is obtained from between 34 and 36 parts by weight, i.e. 35 parts by weight, to between 84 and 86 parts by weight, i.e. 85 parts by weight, i.e. within the range of 35 to 85 parts by weight.

As to the amount of synthetic silica, practically useful effect is obtained from between 4 and 6 parts by weight, i.e. 5 parts by weight, to between 64 and 66 parts by weight, i.e. 65 parts by weight, i.e. within the range of 5 to 65 parts by weight. Particularly better effect is obtained from between 14 and 16 parts by weight, i.e. 15 parts by weight, to between 54 and 56 parts by weight, i.e. 55 parts by weight, i.e. within the range of 15 to 55 parts by weight.

As to the combination of the proportions of the surface active agent and synthetic silica per 100 parts by weight of the solids content of the resin component for water paint, the combination of 5 to 95 parts by weight of the surface active agent and 5 to 65 parts by weight of synthetic silica can give sufficient effect. The results can be improved more in the combination of 5 to 95 parts by weight of the surface active agent and 15 to 55 parts by weight of synthetic silica. The best combination is the surface active agent in an amount of 35 to 85 parts by weight and synthetic silica in an amount of 15 to 55 parts by weight.

Based on the experimental results as shown in Table 1, various aqueous coating compositions are prepared as shown in Table 2 by varying the kinds and amounts of resins for water paint and surface active agents and the proportions of synthetic silica within the ranges mentioned above. A resin for water paint, water-soluble melamine resin, a surface active agent, synthetic silica, triethylamine and a solvent are dispersed by using a dispersion mixer for paint, and subsequently water is added to the dispersion to give an aqueous coating composition having a solids content of 20% by weight. The aqueous coating composition is coated on aluminum fins of a heat exchanger by dip coating and baked under the conditions as shown in Table 2.

For comparison, conventional aqueous coating compositions as shown in Table 3 containing no synthetic silica and no surface active agent are also coated on aluminum fins of heat exchangers by dip coating and baked under the conditions as shown in Table 3.

Various properties of the resulting coating films are tested as mentioned in Table 4 with the results as shown in Table 4. The marks shown in Table 4 have the same meaning as in Table 1.

As is clear from the results in Table 4, the coating films obtained from the aqueous coating compositions as shown in Table 2 containing surface active agents and synthetic silica are remarkably superior to those of conventional ones as shown in Table 3 in hydrophilic properties.

TABLE 2

| Example No. | 1 | 2 | 3 | 4 | 5 | 6 | 7 | 8 |
|---|---|---|---|---|---|---|---|---|
| Water-soluble Resin component for water paint (parts by weight) | Water-soluble alkyd resin 45.0 | Water-soluble acrylic resin 45.0 | Water-soluble polyester resin 30.0 | Water-soluble acrylic-alkyd resin 32.0 | Water-soluble epoxy resin 32.0 | Water-dispersible alkyd resin 60.0 | Water-dispersible acrylic resin 60.0 | Water-dispersible polyester resin 56.1 |
| Water-soluble melamine resin (parts by weight) | 8.0 | 8.0 | 8.0 | 8.0 | 8.0 | 2.0 | — | 8.0 |
| Surface active agent (parts by weight) | Nonionic 17.0 | Nonionic 17.0 | Cationic 15.0 | Anionic 15.0 | Nonionic 17.0 | Anionic 20.0 | Amphoteric 15.0 | Amphoteric 8.0 |
| Synthetic silica (parts by weight) | 10.0 | 10.0 | 15.0 | 3.5 | 3.0 | 14.0 | 16.0 | 15.0 |
| Triethylamine (parts by weight) | — | — | — | 2.5 | 4.0 | — | — | — |
| Solvent (butyl cellosolve) (parts by weight) | 20.0 | 20.0 | 32.0 | 39.0 | 36.0 | 3.0 | 9.0 | 12.9 |
| Parts by weight per 100 parts by weight of the solids content of the resin component — Surface active agent | 61 | 61 | 53 | 54 | 61 | 74 | 56 | 29 |
| Parts by weight per 100 parts by weight of the solids content of the resin component — Synthetic silica | 36 | 36 | 53 | 13 | 11 | 52 | 59 | 53 |
| Thickness of coating film after dried (μm) | 11 | 7 | 5 | 7 | 5 | 10 | 15 | 7 |
| Baking conditions | | | | | | | | |
| (°C.) | 150 | 180 | 150 | 180 | 200 | 120 | 120 | 180 |
| (min.) | 20 | 20 | 30 | 15 | 10 | 30 | 10 | 20 |

| Example No. | 9 | 10 | 11 | 12 | 13 | 14 | 15 |
|---|---|---|---|---|---|---|---|
| Water-soluble Resin component for water paint (parts by weight) | Water-soluble alkyd resin | — | Water-soluble alkyd resin | Water-soluble acrylic | Water-soluble polyester | — | Water-soluble acrylic-alkyd |

TABLE 2-continued

| | | | | | | | |
|---|---|---|---|---|---|---|---|
| | 45.0 | | 45.0 | resin 45.0 | resin 30.0 | | resin 32.0 |
| Water-soluble melamine resin (parts by weight) | 8.0 | 50.0 | 8.0 | 8.0 | 8.0 | 50.0 | 8.0 |
| Surface active agent (parts by weight) | Nonionic 8.0 | Nonionic 30.0 | Nonionic 25.5 | Nonionic 8.0 | Amphoteric 8.0 | Nonionic 3.0 | Nonionic 25.5 |
| Synthetic silica (parts by weight) | 15.0 | 15.0 | 10.0 | 3.5 | 17.0 | 3.5 | 17.0 |
| Triethylamine (parts by weight) | — | — | — | — | — | — | 2.5 |
| Solvent (butyl cellosolve) (parts by weight) | 24.0 | 5.0 | 11.5 | 35.5 | 37.0 | 16.5 | 15.0 |
| Parts by weight per 100 parts by weight of the solids content of the resin component — Surface active agent | 29 | 86 | 91 | 29 | 29 | 86 | 91 |
| Parts by weight per 100 parts by weight of the solids content of the resin component — Synthetic silica | 53 | 43 | 36 | 13 | 61 | 10 | 61 |
| Thickness of coating film after dried (μm) | 10 | 10 | 10 | 8 | 6 | 12 | 9 |
| Baking conditions | | | | | | | |
| (°C.) | 150 | 140 | 150 | 180 | 150 | 140 | 180 |
| (min.) | 20 | 20 | 20 | 25 | 30 | 20 | 15 |

Note
Water-soluble resins:
Water-soluble alkyd resin = WATERSOL S-126, solids content 50 ± 2%, Japan Reichold Co.
Water-soluble acrylic resin = WITALOID 7110, solids content 50 ± 2%, Hitachi Chemical Co., Ltd.
Water-soluble polyester resin = ALMATEX WP-616, solids content 75± 2%, Mitsui Toatsu Chemicals, Inc.
Water soluble acrylic-alkyd resin = CKS-415, solids content 70 ± 2% Nippon Synthetic Chemical Industry Co., Ltd.
Water-soluble epoxy resin = DX-16, solids content 70 ± 2%, Shell Chemical Co.
Water-dispersible alkyd resin = WATERSOL S-333, solids content 43 ± 2%, Japan Reichhold Co.
Water-dispersible acrylic resin = ALMATEX E-208, solids content 45 ± 2%, Mitsui Toatsu Chemicals, Inc.
Water-dispersible polyester resin = PHTHALKYD, solids content 40 ± 2%, Hitachi Chemical Co., Ltd.
Water-soluble melamine resin = NIKALAC MW22, solids content 70 ± 2%, Sanwa Chemical Co.
Surface active agents:
Nonionic = polyoxyethylene nonylphenol ether, NONION NS 210, Nippon Oil & Fats Co., Ltd.
Cationic = trimethyloctadecyl ammonium chloride, CATION AB, Nippon Oil & Fats Co., Ltd.
Anionic = sodium dioctylsulfosuccinate, RAPISOL B-30, Nippon Oil & Fats Co., Ltd.
Amphoteric = dimethylalkyl (coconut) betaine ANNON BF, Nippon Oil & Fats Co., Ltd.
Synthetic silica:
SYLOID 244, Fuji-Devision Chemical Co.

TABLE 3

| Comparative Example No. | 1 | 2 | 3 | 4 | 5 |
|---|---|---|---|---|---|
| Resin for water paint (parts by weight) | Water-soluble alkyd resin 81.0 | Water-soluble acrylic resin 81.0 | Water-soluble polyester resin 36.5 | Water-soluble acrylic-alkyd resin 63.0 | Water-soluble epoxy resin 58.5 |
| Water-soluble melamine resin (parts by weight) | 14.4 | 14.4 | 47.3 | 15.6 | 10.4 |
| Triethylamine (parts by weight) | — | — | — | 3.8 | 3.0 |
| Solvent (parts by weight) | Butyl cellosolve 4.6 | Isopropyl alcohol 3.0 Butyl cellosolve 1.6 | Butyl cellosolve 16.2 | Butyl cellosolve 17.6 | Butyl cellosolve 28.1 |
| Thickness of coating film after dried (μm) | 11 | 7 | 5 | 7 | 5 |
| Baking conditions | | | | | |
| (°C.) | 150 | 180 | 150 | 220 | 200 |
| (min.) | 20 | 20 | 30 | 5 | 10 |

| Comparative Example No. | 6 | 7 | 8 | 9 |
|---|---|---|---|---|
| Resin for water paint (parts by weight) | Water-dispersible alkyd resin 90.0 | Water-dispersible acrylic resin 90.0 | Water-dispersible polyester resin 73.0 | — |
| Water-soluble melamine resin (parts by weight) | 3.0 | — | 10.4 | 60.0 |
| Triethylamine (parts by weight) | — | — | — | — |
| Solvent (parts by weight) | Butyl cellosolve 7.0 | Butyl cellosolve 5.0 Water 5.0 | Butyl cellosolve 16.6 | Butyl cellosolve 40.0 |
| Thickness of coating film after dried (μm) | 10 | 15 | 7 | 10 |
| Baking conditions | | | | |
| (°C.) | 120 | 100 | 18 | 140 |
| (min.) | 30 | 30 | 20 | 20 |

TABLE 4

| Test item | Test method | Example 1 | 2 | 3 | 4 | 5 | 6 | 7 | 8 | 9 | 10 | 11 | 12 |
|---|---|---|---|---|---|---|---|---|---|---|---|---|---|
| Pencil hardness | JIS standard | H | 2H | 2H | H | 3H | H | F | F | H | H | H | 3H |
| Adhesiveness | Cross-cut test (peeled off by using adhesive tape) | 100/100 | 100/100 | 100/100 | 100/100 | 100/100 | 100/100 | 100/100 | 100/100 | 100/100 | 100/100 | 100/100 | 100/100 |
| Hydrophilic properties | Water drops are sprayed by sprayer | ◎ | ◎ | ◎ | ○ | ○ | ◎ | ◎ | ○ | ○ | ◎ | ◎ | Δ |
| Water resistance | 25° C., city water, 6 months | ◎ | ◎ | ◎ | ◎ | ◎ | ◎ | ◎ | ◎ | ◎ | ◎ | ○ | ◎ |
| Warm water resistance | 50° C., city water, 6 months | ○ | ◎ | ◎ | ○ | ◎ | ◎ | ○ | ○ | ○ | ○ | ○ | ◎ |
| Moisture resistance | 50° C., 98% RH, 3 months | ○ | ◎ | ◎ | ○ | ◎ | ◎ | Δ | ○ | ◎ | ○ | ○ | ◎ |
| Resistance to salt water spray | 35° C., 5% NaCl aq. solution, 1 month | ○ | ○ | ○ | ○ | ○ | ○ | Δ | ○ | ◎ | ○ | Δ | ◎ |
| Resistance to cass | Ag. solu. of NaCl, $CH_3COOH$ and CuCl, pH 3.1, 10 days | ○ | ○ | ○ | Δ | ○ | ○ | Δ | Δ | ○ | ○ | Δ | ○ |
| Acccelerated weather resistance | Sunshine type weather-o-meter, 500 hours | ◎ | ◎ | ◎ | ○ | Δ | ○ | ○ | ○ | ○ | ○ | ◎ | ○ |
| Weather resistance | At Totsuka, Yokohama-shi, Japan, 6 months | ◎ | ◎ | ◎ | ◎ | ○ | ◎ | ○ | ◎ | ○ | ◎ | ◎ | ◎ |
| Alkali resistance | Saturated aq. solution of $Ca(Oil)_2$, 10 days | Δ | ○ | Δ | Δ | Δ | Δ | Δ | Δ | Δ | Δ | Δ | ○ |
| Heating and cooling cycle | 100° C., 2 hours - 20° C., 2 hrs, 100 cycles | ◎ | ◎ | ◎ | ◎ | ◎ | ○ | ○ | ◎ | ◎ | ◎ | ◎ | ◎ |
| Hydrophilic properties after various tests | | | | | | | | | | | | | |
| After water resistance test | Water drops are sprayed by sprayer | ◎ | ◎ | ◎ | ◎ | ◎ | ◎ | ◎ | ◎ | ◎ | ◎ | ◎ | ◎ |
| After warm water resistance test | Water drops are sprayed by sprayer | ◎ | ◎ | ◎ | ◎ | ◎ | ◎ | ◎ | ◎ | ◎ | ◎ | ◎ | ◎ |
| After moisture resistance test | Water drops are sprayed by sprayer | ◎ | ◎ | ◎ | ◎ | ◎ | ◎ | ◎ | ◎ | ◎ | ◎ | ◎ | ◎ |
| After salt water spray resistance test | Water drops are sprayed by sprayer | ◎ | ◎ | ◎ | ◎ | ◎ | ◎ | ◎ | ◎ | ◎ | ◎ | ◎ | ◎ |
| After casse resistance test | Water drops are sprayed by sprayer | ◎ | ◎ | ◎ | ◎ | ◎ | ◎ | ◎ | ◎ | ◎ | ◎ | ◎ | ◎ |
| After accelerated weather resistance test | Water drops are sprayed by sprayer | ◎ | ◎ | ◎ | ◎ | ◎ | ◎ | ◎ | ◎ | ◎ | ◎ | ◎ | ◎ |
| After weather resistance test | Water drops are sprayed by sprayer | ◎ | ◎ | ◎ | ◎ | ◎ | ◎ | ◎ | ◎ | ◎ | ◎ | ◎ | ◎ |
| After alkali resistance test | Water drops are sprayed by sprayer | ◎ | ◎ | ◎ | ◎ | ◎ | ◎ | ◎ | ◎ | ◎ | ◎ | ◎ | ◎ |
| After heating and cooling cycle test | Water drops are sprayed by sprayer | ◎ | ◎ | ◎ | ◎ | ◎ | ◎ | ◎ | ◎ | ◎ | ◎ | ◎ | ◎ |

TABLE 4-continued

| Test item | Test method | Example 13 | Example 14 | Example 15 | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|---|---|---|---|
| Pencil Hardness | JIS standard | 2H | H | F | H | 3H | 2H | 2H | 3H | H | F | H | 2H |
| Adhesiveness | Cross-cut test (peeled off by using adhesive tape) | 100/100 | 100/100 | 100/100 | 100/100 | 100/100 | 100/100 | 100/100 | 100/100 | 100/100 | 100/100 | 100/100 | 100/100 |
| Hydrophilic properties | Water drops are sprayed by sprayer | ⊙ | Δ | ⊙ | x | x | x | x | x | x | x | x | x |
| Water resistance | 25° C., city water, 6 months | ○ | ⊙ | ○ | ⊙ | ⊙ | ⊙ | ⊙ | ⊙ | ⊙ | ⊙ | ⊙ | ⊙ |
| Warm water resistance | 50° C., city water, 6 months | ○ | ⊙ | Δ | ○ | ⊙ | ⊙ | ○ | ⊙ | ⊙ | ○ | ○ | ○ |
| Moisture resistance | 50° C., 98% RH, 3 months | ○ | ⊙ | Δ | ○ | ⊙ | ⊙ | ○ | ⊙ | ⊙ | ○ | ○ | ⊙ |
| Resistance to salt water spray | 35° C., 5% NaCl aq. solution, 1 month | Δ | ○ | Δ | ⊙ | ⊙ | ⊙ | ⊙ | ⊙ | ○ | ⊙ | ⊙ | ⊙ |
| Resistance to cass | Ag.solu. of NaCl, $CH_3COOH$ and CuCl, pH 3.1, 10 days | Δ | ○ | Δ | ○ | ○ | ○ | ○ | ○ | ○ | ○ | ○ | ○ |
| Accelerated weather resistance | Sunshine type weather-o-meter, 500 hours | Δ | ○ | Δ | ⊙ | ⊙ | ⊙ | ⊙ | ⊙ | ○ | ⊙ | ⊙ | ⊙ |
| Weather resistance | At Totsuka, Yokahoma-shi, Japan, 6 months | Δ | ⊙ | Δ | ⊙ | ⊙ | ⊙ | ⊙ | ⊙ | ○ | ⊙ | ⊙ | ⊙ |
| Alkali resistance | Saturated aq. solution of $Ca(OH)_2$, 10 days | Δ | Δ | Δ | Δ | ⊙ | ○ | ○ | ○ | Δ | ○ | ○ | ○ |
| Heating and cooling cycle | 100° C., 2 hours - 20° C., 2 hrs, 100 cycles | ○ | Δ | Δ | ○ | ⊙ | ⊙ | ⊙ | ⊙ | ⊙ | ⊙ | ⊙ | ⊙ |
| Hydrophilic properties after various tests | | | | | | | | | | | | | |
| After water resistance test | Water drops are sprayed by sprayer | ⊙ | ⊙ | ⊙ | x | x | x | x | x | x | x | x | x |
| After warm water resistance test | Water drops are sprayed by sprayer | ⊙ | ⊙ | ⊙ | x | x | x | x | x | x | x | x | x |
| After moisture resistance test | Water drops are sprayed by sprayer | ⊙ | ⊙ | ⊙ | x | x | x | x | x | x | x | x | x |
| After salt water spray resistance test | Water drops are sprayed by sprayer | ⊙ | ⊙ | ⊙ | x | x | x | x | x | x | x | x | x |
| After cause resistance test | Water drops are sprayed by sprayer | ⊙ | ⊙ | ⊙ | x | x | x | x | x | x | x | x | x |
| After accle-rated weather resistance test | Water drops are sprayed by sprayer | ⊙ | ⊙ | ⊙ | x | x | x | x | x | x | x | x | x |
| After weather resistance test | Water drops are sprayed by sprayer | ⊙ | ⊙ | ⊙ | x | x | x | x | x | x | x | x | x |
| After alkali resistance test | Water drops are sprayed by sprayer | ⊙ | ⊙ | ⊙ | Δ | x | x | x | x | Δ | x | x | x |
| After heating and cooling cycle test | Water drops are sprayed by sprayer | ⊙ | ⊙ | ⊙ | x | x | x | x | x | x | x | x | x |

Figure 4:
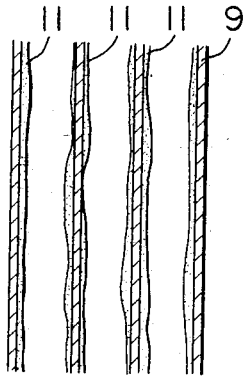
FIG. 4 is a cross sectional view of fins of the heat exchanger according to this invention wherein water is adhered to the fins filmwise.

On the other hand, as to heat exchange properties of the heat exchanger according to this invention, since adhered condensed water is instantly and continuously absorbed on the hydrophilic coating film, that is, by the porosity of synthetic silica and the action of surface active agent, the condensed water 11 flows down filmwise as shown in FIG. 4 in contrast to forming semicircular drops on the fins or bridging between fins from the condensed water 10 as in the case of conventional ones shown in FIG. 3. Thus the passing area of air between fins is enlarged, so that resistance to air flow is remarkably decreased and the amount of flow can be increased.

Figure 5:
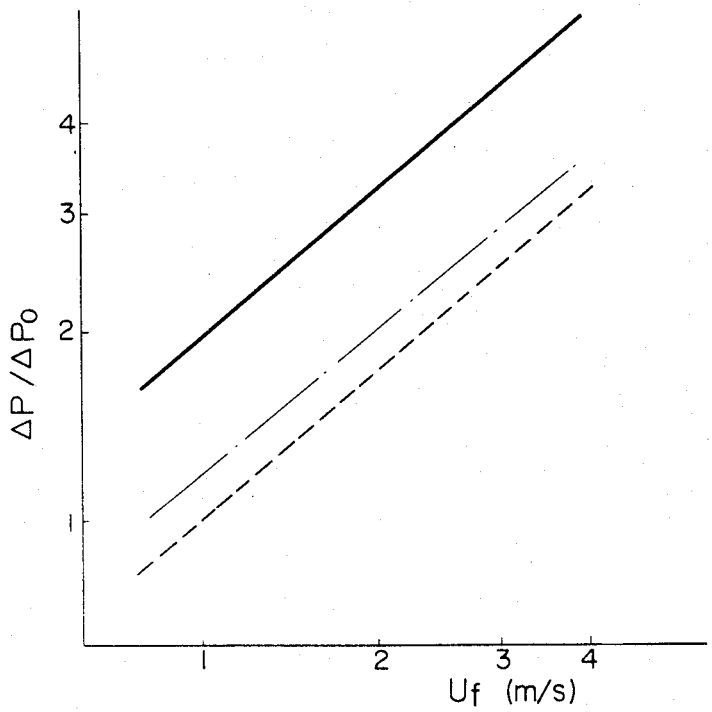
FIG. 5 is a graph showing changes of air flow resistance.

FIG. 5 shows a rate of decrease in resistance to flow by plotting the ratio $\Delta P/\Delta P_o$ vs front air velocity $U_f$ (m/sec). In FIG. 5, the dotted line shows one in the case of dry air and the surfaces of fins are not treated or treated according to a conventional method, the chain line shows one in the case of humid air and the surfaces of fins are treated according to this invention, and the solid line shows one in the case of humid air and the surfaces of fins are not treated, treated with chromate, treated with organic resin coating film or treated with a conventional aqueous coating composition to form a coating film. The symbol $\Delta P_o$ is resistance to flow at dry air state when $U_f = 1.0$ (m/sec).

As is clear from FIG. 5, the resistance to flow of the heat exchanger according to this invention is remarkably smaller than those of conventional ones and is near to the resistance of flow at dry air state.

What is claimed is:

1. A heat exchanger coated with an aqueous coating composition comprising a plurality of spaced fins with narrow distance in parallel to form flow passages between fins and a plurality of heat transfer pipes passing through said fins, the both surfaces of said fins being coated with an aqueous coating composition comprising 100 parts by weight of a resin component for water paint in solids content, 5 to 95 parts by weight of a surface active agent and 5 to 65 parts by weight of synthetic silica and baked at a temperature of 120° C. to 200° C. for 10 to 40 minutes for curing to give a coating film of 3 to 20 μm, whereby said fins are provided with hydrophilic surfaces having excellent corrosion resistance and surface hardness.

2. A heat exchanger according to claim 1, wherein the aqueous coating composition contains 5 to 95 parts by weight of a surface active agent and 15 to 55 parts by weight of synthetic silica per 100 parts by weight of the solids content of the resin component for water paint.

3. A heat exchanger according to claim 1, wherein the aqueous coating composition contains 35 to 85 parts by weight of a surface active agent and 15 to 55 parts by weight of synthetic silica per 100 parts by weight of the solids content of the resin component for water paint.

4. A heat exchanger according to claim 1, 2 or 3, wherein the surface active agent is a nonionic surface active agent.

5. A heat exchanger according to claim 1, wherein the resin component for water paint is one or more member selected from the group consisting of water-soluble amino resins, acrylic resins, alkyd resins, polyester resins, epoxy resins, acrylic-alkyd resins and water-dispersible alkyd resins, acrylic resins, and polyester resins.

6. A heat exchanger according to claim 4, wherein said nonionic surface active agent is selected from the group consisting of polyoxyethylene nonylphenol ether, polyoxyethylene octylphenol ether, oxyethylene block polymer, oxypropylene block polymer, and polyoxyethylene glycol.

7. A heat exchanger according to claim 1, 2 or 3, wherein said synthetic silica is obtained as a precipitate resulting from the reaction of a silicate solution with carbon dioxide.

8. A heat exchanger according to claim 1, 2 or 3, wherein said fins are made of aluminum.

9. A heat exchanger according to claim 1, 2 or 3, wherein said surface active agent is selected from the group consisting of nonionic, anionic, cationic and amphoteric surface active agents and mixtures thereof.

* * * * *